United States Patent [19]

Creamer et al.

[11] 4,175,025

[45] Nov. 20, 1979

[54] SEALED MEMBRANE FILTER PRESS ELECTROLYTIC CELLS

[75] Inventors: Edward D. Creamer, Ypsilanti, Mich.; Michael Krumpelt, Naperville, Ill.

[73] Assignee: BASF Wyandotte Corporation, Wyandotte, Mich.

[21] Appl. No.: 922,592

[22] Filed: Jul. 7, 1978

[51] Int. Cl.[2] ..... C25B 9/00; C25B 13/00

[52] U.S. Cl. ..... 204/253; 204/279

[58] Field of Search ..... 204/252, 253, 254–258, 204/279

[56] References Cited

U.S. PATENT DOCUMENTS

| | | | |
|---|---|---|---|
| 4,013,535 | 3/1977 | White | 204/258 X |
| 4,013,537 | 3/1977 | White | 204/128 X |
| 4,026,782 | 5/1977 | Bouy et al. | 204/279 X |
| 4,028,209 | 6/1977 | Labedan et al. | 204/279 X |
| 4,051,009 | 9/1977 | Schweichart et al. | 204/279 |

FOREIGN PATENT DOCUMENTS

| | | | |
|---|---|---|---|
| 472894 | 5/1974 | Australia | 204/258 |

*Primary Examiner*—John H. Mack
*Assistant Examiner*—D. R. Valentine
*Attorney, Agent, or Firm*—Robert J. Henry; Joseph D. Michaels; Robert E. Dunn

[57] ABSTRACT

An electrolysis cell assembly of the filter press type having plastic frames and a membrane wherein the membrane is formed to fit between adjacent frames with one or more recesses provided on one or both of the adjacent frames together with sealing gasket means which are formed for effectively controlling electrode spacing and for retaining the membrane in position without membrane damage. The construction not only provides proper sealing and protection of the membrane during use, but also allows for the membrane to be removed, reactivated, and reused.

8 Claims, 2 Drawing Figures

Fig-1
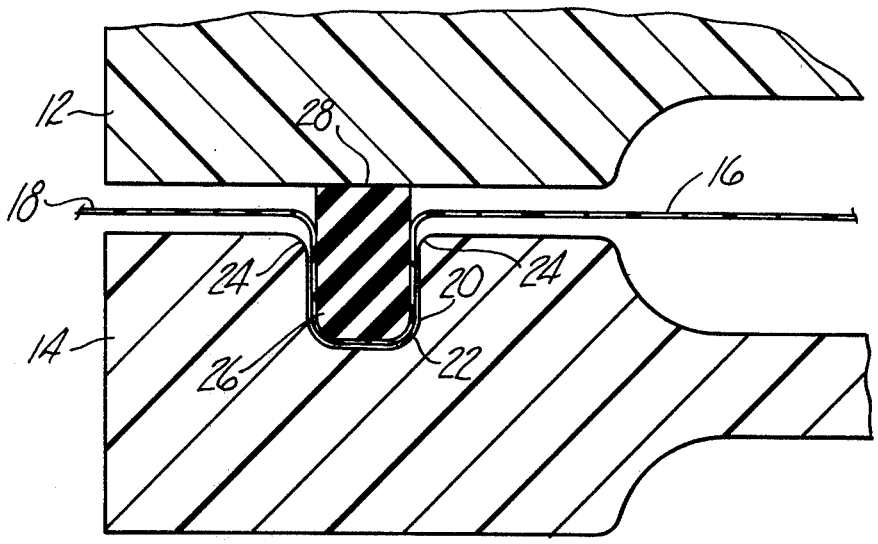
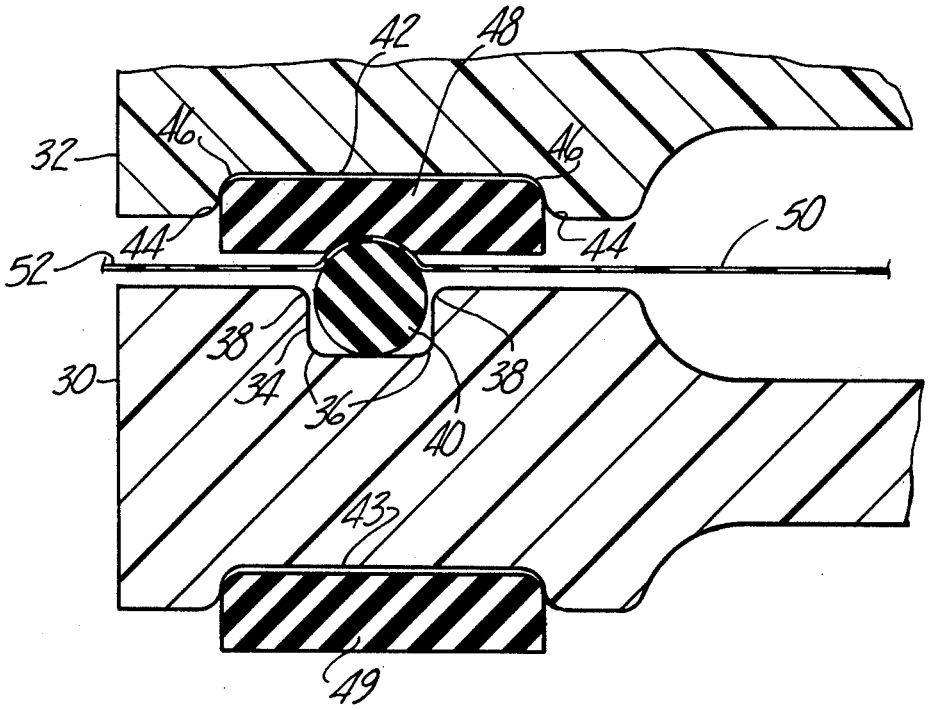
Fig-2

SEALED MEMBRANE FILTER PRESS ELECTROLYTIC CELLS

BACKGROUND OF THE INVENTION

1. Field of the Invention

The present invention relates to an electrolysis cell assembly of the filter press type having plastic frames and a membrane together with means for sealing the membrane through clamping forces. The invention particularly pertains to such cells suitable for use in the electrolysis of sodium chloride, and in which membranes may be removed and replaced or reactivated and reused individually.

2. Prior Art

As is known to those skilled in the art, a cell frame comprises the basic repeat unit in an electrolytic filter press cell. The cell frame functions as a separator or barrier between the anode of one cell and the cathode of the adjacent cell. A linear series of cathodes, anodes and interposed cell frames constitutes a filter press cell, in toto.

The prior art is repleat with a wealth of technology respecting filter press cells. Generally, however, the prior art has given considerable attention to electrode construction, diaphragm materials and the like. On the other hand, little attention has been directed to the cell frame and to means and methods of sealing diaphragms therein.

In general, in chlor-alkali filter press cells, the chambers are divided by diaphragms or membranes. The diaphragms may be adhered to the cathode screen or affixed by other methods so that alternatives in diaphragm construction have been worked out in a variety of ways. However, membrane sheets are usually spaced closely to or adjacent to the cathode screen and are often sealingly anchored by means other than connection to the cathode screen. Thus, in chlor-alkali membrane filter press cells, this sealing is extremely difficult and critical. One side of the membrane contains hot chlorinated brine which is highly corrosive and prone to seepage and the other side of the membrane contains hot caustic. Leaks of either presents a dangerous safety hazard.

Traditional electrolytic cells are exemplified by diaphragm chlor-alkali cells consisting of an anode base, a cathode can and a top. These are typically sealed to one another by a foam or soft rubber flat gasket. Sealing and electrical insulation are the important functions of the gasket. Spacing between parts is not critical and the diaphragm is deposited on the cathode and thus does not protrude into the sealing area.

In the new membrane filter press cells, gaskets must seal the membrane to the frame and serve also to control the electrode spacing. Conventional filter presses solved the sealing requirement with a caulked recessed design.

U.S. Pat. No. 4,026,782 illustrates the latest prior technology where the membrane is sealed to the frame through a caulked gasket. This patent also shows an auxiliary seal gasket which assists in the prevention of leakage. However, in such arrangements, the membrane is permanently affected by the sealing operation and therefore cannot be satisfactorily regenerated and reused. This is because the membrane generally shrinks during regeneration, and therefore, it will no longer fit the cell.

SUMMARY OF THE INVENTION

Thus, in accordance with the invention, a electrolysis cell assembly is provided which satisfactorily seals the membrane to the plastic frames, and yet which allows the membrane to be removed and regenerated periodically without any adverse affect on the sealing of the regenerated membrane.

Briefly speaking, this and other objectives are obtained by providing an electrolysis cell assembly of the filter press type having plastic frames, wherein the assembly comprises a membrane formed to fit between adjacent frames, and having a surface area substantially larger than the frames; a recess in at least one of said adjacent frames extending around the periphery of the frame; and a gasket formed to fit into said recess and bear against the other of said adjacent frames, whereby the gasket holds the membrane in position and provides a complete seal between the frames when they are forced relatively together by clamping forces.

In the assembly, the membrane preferably extends considerably beyond the periphery of the frames when in assembled position. In this way, the membrane may be removed and reactivated, and still returned to the frame in the same location or in another position even though the membrane will have shrunk somewhat. In addition, it is possible to reactivate the membrane a plurality of times and still have it fit properly in the assembly.

The grooves in the frames are preferably rounded at the bottom and top so as to render the plastic housing stronger when subjected to the clamping pressure holding the assembly together. In addition, this construction is particularly important in one of the embodiments of the invention wherein the membrane fits into the recess. The gaskets are formed to be subjected to substantially the entire ram pressure so as to protect the frame members further from rupture and to allow for a controlled sealing force. In other words, good sealing requires considerable ram pressure and it is best utilized in this fashion.

In another embodiment of the invention, two grooves are utilized together with two sealing gaskets, with a groove being provided in each adjacent frame and a gasket fitting within each groove. One groove is larger than the other and contains a large gasket extending on each side of the recess or groove containing the smaller gasket. With this construction, the membrane is placed between the two gaskets and kept in a relatively flat position. The smaller hard gasket holds the membrane without stretching it, and the large soft gasket assures a satisfactory seal.

BRIEF DESCRIPTION OF THE DRAWINGS

In the accompanying drawings, wherein like numerals are used to designate like parts throughout, FIG. 1 is a cross-sectional view of a portion of adjacent filter press cell frames illustrating the sealing assembly according to the invention; and FIG. 2 is a cross-sectional view similar to FIG. 1 except that it shows an alternate embodiment of the invention.

While only the preferred forms of the invention are shown in the drawings, it will be appreciated that various changes and modifications may be made therein without departing from the spirit and scope of the invention as defined in the appended claims.

DESCRIPTION OF THE PREFERRED EMBODIMENTS

Referring more particularly to the drawings, there is shown in FIG. 1 a pair of adjacent filter press frames 12 and 14 constructed from plastic such as filled polypropylene. The frames are of typical construction and contain the various units of an electrolytic filter press cell which may be monopolar or bipolar. A typical filter press cell unit, which may be sealed in accordance with the invention, is a bipolar electrolytic filter press cell frame shown in U.S. Pat. No. 4,051,009, and the disclosure of that patent is incorporated herein by reference. The cell assembly also contains a membrane 16 which is typically larger than the frames 12 and 14 and extends beyond the periphery thereof at 18. In its broad aspect, the invention may include any of the usual separators for chlor-alkali cells, but the invention is particularly applicable to the membrane separators used in the typical membrane filter press cells. A preferred membrane is a special fluorocarbon polymer made by DuPont under the tradename "NAFION".

Referring again to FIG. 1, it is seen that the frame 14 has a recess 20 cut therein and formed with its inner surfaces 22 and outer surfaces 24 rounded. A gasket 26 is provided which is formed to fit into the recess 20 and secure the membrane 16 therein. Gasket 26 is formed to protrude from the recess and has a flat surface 28 formed to bear against the adjacent frame member 12. The gasket is an elastomer such as EPDM (a polymer from ethylene propylene dimonomer), Hypalon or Neoprene.

A typical gasket and groove will have a rectangular or square cross section with the exception of the matching rounded edges. Similarly, with rectangular frames, the grooves are rounded at the corners. This rounding is important in order to prevent weak spots in the plastic frame that may rupture under the clamping pressure holding the unit together and to protect the membrane from breakage. In assembling the unit, it is preferred to use fluorocarbon lubricants, and to use a gasket which will give a snug fit in the groove with a membrane. The gasket height is chosen to provide the proper electrode spacing upon compression. In addition, the gasket height is such that substantially all of the clamping pressure is exerted through the gasket and is thereby fully devoted to the sealing function. This design is superior to the standard caulked-recessed filter press design in that the single groove is less expensive to construct, requires only one set of gasketing, and allows the membrane to protrude from the cell uncut.

Referring now more particularly to FIG. 2, there is shown an alternate embodiment of the invention wherein the electrolysis cell assembly comprises a plurality of frames such as the adjacent frames 30 and 32. Each of these frames is similar in construction and contain the usual interior components (not shown) to form a bipolar electrolytic filter press system. On one side thereof, frame 30 is formed with a narrow recess 34 rounded at the inner and outer surfaces 36 and 38 as shown in FIG. 2, and constructed to receive gasket 40. The gasket 40 is typically of an O-ring or D-ring construction adapted to fit into the recess 34. This O-ring or D-ring is again composed of an elastomer such as EPDM, Hypalon, or Neoprene, but it is generally hard and will have a Shore A durometer of say from 60 to 90.

On the matching adjacent frame 32, there is provided a recess 42 which is substantially wider than the recess 34 and extends beyond both sides thereof. The recess 42 is also rounded at its inner and outer surfaces 44 and 46 as shown. A second gasket 48 is sized to fit snuggly within recess 42 and extend outwardly therefrom a fixed controlled distance. Frame 30 has a recess 43 similar to recess 42 of frame 32 and is equipped with a gasket 49 similar to gasket 48 for sealing with the next adjacent unit. Membrane 50 is disposed between adjacent frame members and fits between the two gaskets 40 and 48 with a size sufficient to extend beyond the periphery of the cell frames as at 52. Gasket 48 is also constructed of an elastomer such as EPDM, Hypalon or Neoprene but will have a durometer of 40 to 70 on the Shore A scale and further will be at least 10 and preferably 20 Shore A units less than the durometer of the harder gasket. In this way, the hard gasket will push into the softer gasket on assembly and form a clamping engagement of the membrane without stretching or causing injury to the membrane.

The advantages of this system over the conventional caulked recess design is that it seals at lower ram forces. This places less stress on the cell frames and permits the use of smaller, less expensive rams and press structures. The membrane is also allowed to protrude without cutting to size, so as to be reusable as explained above. It will be appreciated, that the assembly according to the invention, which does not stretch the membrane, is important in providing for the reuse of the membrane.

In the following examples, which are given to be illustrative only, there is shown a series of tests illustrating the sealing ability of the assembly constructed according to the invention.

EXAMPLE 1

An EPDM Nordell 70 Shore A durometer gasket having cross-sectional dimensions of $\frac{3}{8}$ inch by $\frac{3}{8}$ inch was used to caulk a Nafion 313 membrane. The gasket was forced into a $\frac{3}{8}$ inch wide by 5/16 inch deep groove with the membrane held therebetween as in the embodiment of FIG. 1. The groove overall perimeter was rectangular at 7 feet by 4 feet with the corners thereof rounded. This system sealed with a compressive force of 200 pounds ram pressure per inch of gasket.

EXAMPLE 2

An EPDM Nordell 70 Shore A durometer gasket having a cross section $\frac{1}{4}$ inch wide by $\frac{3}{8}$ inch deep was used to caulk a Nafion 313 membrane in a $\frac{1}{4}$ inch by $\frac{1}{4}$ inch groove. The overall groove perimeter was rectangular at 7 feet by 4 feet lengths with the corners thereof rounded. This system sealed at 200 pounds ram pressure per inch of gasket.

EXAMPLE 3

A Neoprene 60 Shore A durometer gasket having a cross section $\frac{1}{2}$ inch wide by $\frac{3}{8}$ inch deep was used to caulk a Nafion 313 membrane in a $\frac{1}{2}$ inch wide by $\frac{1}{4}$ inch deep groove. The results were similar to those of Examples 1 and 2.

EXAMPLE 4

A 5/16 inch diameter Neoprene O-ring was fitted into a dovetail groove of the embodiment of FIG. 2. On the opposed frame, a $\frac{1}{2}$ inch wide by $\frac{3}{8}$ inch deep Neoprene gasket in a $\frac{1}{2}$ inch wide by $\frac{1}{4}$ inch deep groove was fitted. The membrane was stretched over the $\frac{1}{2}$ inch wide by $\frac{3}{8}$ inch deep gasket and stapled to the sides of the cell so as not to wrinkle upon compression. This system sealed at 100 pounds ram pressure per inch of gasket.

After the tests in the above examples were made, it was found that the required ram pressures can be reduced by improved machining of the frames.

The embodiments of the invention in which an exclusive property or privilege is claimed are defined as follows:

1. In an electrolysis cell assembly of the filter-press type having frames, wherein the assembly comprises a membrane formed to fit between adjacent frames, and having a surface area substantially larger than the frames, a recess in at least one of said adjacent frames extending around the periphery of the frame, and a gasket formed to fit into said recess and bear against the other of said adjacent frames, whereby the gasket holds the membrane in position and provides a complete seal between the frames when they are forced relatively together by clamping forces, said membrane being sized to extend beyond the periphery of the frames when in assembled position.

2. The electrolysis cell assembly of claim 1, wherein the clamping forces are substantially taken up by the gasket.

3. The electrolysis cell assembly of claim 1, wherein the recess is rounded at the inner and outer portions thereof.

4. In an electrolysis cell assembly of the filter press type having frames, wherein the assembly comprises a membrane formed to fit between adjacent frames when is assembled position, and having a surface area larger than the frames, a recess in one of said adjacent frames extending completely around the frame and having rounded surfaces on the inner and outer portion thereof, and a gasket formed to fit into said recess in matching relation therein, said membrane being fit into said recess between the gasket and the frame containing the recess, and having sufficient size to fit the recess and extend beyond the frame periphery, whereby the gasket holds the membrane in position and provides a complete seal between the frames when they are forced relatively together by a clamping forces.

5. The electrolysis cell assembly of claim 4, wherein the clamping forces are substantially taken up by the gasket.

6. In an electrolytic cell assembly of the filter-press type having frames, wherein the assembly comprises a membrane formed to fit between adjacent frames when in assembled position and having a surface area larger than the frames, a first recess on one of said adjacent frames extending completely around said first frame, a first gasket made of hard material and formed to fit into said first recess, a second recess on the other of said adjacent frames extending completely around said second frame and being substantially wider than the first recess and extending beyond each side thereof, and a second gasket made of relatively soft material and formed to fit in substantially matching relation within said second recess, said membrane being disposed between said gaskets and extending to or beyond the periphery of the frames.

7. The electrolysis cell assembly of claim 6, wherein the clamping forces are substantially taken up by the second gasket.

8. The electrolysis cell assembly of claim 6, wherein the recesses are rounded at the inner and outer portions thereof.

* * * * *